US006597877B1

(12) United States Patent
Luque

(10) Patent No.: US 6,597,877 B1
(45) Date of Patent: Jul. 22, 2003

(54) APPARATUS FOR DETECTING UNACCEPTABLE MEDIA

(75) Inventor: Phillip R. Luque, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/152,231

(22) Filed: May 20, 2002

(51) Int. Cl.[7] ..... G03G 15/00
(52) U.S. Cl. ..... 399/45; 399/389
(58) Field of Search ..... 399/23, 24, 45, 399/363, 381, 389

(56) References Cited

U.S. PATENT DOCUMENTS 6,006,668 A 12/1999 Rehmann
6,217,168 B1 4/2001 Elgee
6,381,422 B1 * 4/2002 Tanaka ..... 399/45
6,386,676 B1 * 5/2002 Yang et al. ..... 347/19

* cited by examiner

*Primary Examiner*—Hoang Ngo

(57) ABSTRACT

The present invention relates to an apparatus for use in detecting unacceptable input media, the apparatus including a contacting element configured to engage input media during a feed operation such that the contacting element may selectively adhere to unacceptable input media and move with such unacceptable input media during the feed operation. The apparatus also includes a sensor configured to identify displacement of the contacting element, such displacement being indicative of unacceptable input media.

32 Claims, 1 Drawing Sheet

APPARATUS FOR DETECTING UNACCEPTABLE MEDIA

BACKGROUND OF THE INVENTION

Two common styles of printing devices are laser printers and inkjet printers. Laser printers typically "print" by applying toner to media and then thermally bonding the applied toner to the media using a fuser, which generally takes the form of a heated roller. For such laser printers, toner may be colored toner, or black toner. Inkjet printers typically "print" by heating liquid ink within a printhead. Such heating may cause ink to be expelled from orifices in the printhead and onto the media. The expelled liquid ink typically cures, or dries, on the media.

Various forms of media may be employed with such laser and inkjet printers. For example, both paper and transparent media are commonly used. Differing types of paper media typically may be employed interchangeably with either laser or inkjet printers. However, transparent media for use with laser printers may have material properties that are different from those of transparent media for use with inkjet printers. In this regard, types of transparent media adapted for use in laser printers typically have a higher melting point than transparent media adapted for use in inkjet printers. This higher melting point generally prevents the laser transparent media from melting when in contact with the fuser during printing.

As will be appreciated, melting of transparent media in a laser printer is undesirable as it may cause damage to the fuser, rendering the printer inoperable. Inkjet transparent media thus typically is unacceptable for use in laser printers. Furthermore, although laser transparent media may be employed with an inkjet printer with no adverse effects to the printer the Ink may not properly adhere to the laser media. Unfortunately, where differing types of media are available, the potential for confusion exists.

SUMMARY OF THE INVENTION

The present invention relates to an apparatus for use in detecting unacceptable input media. The apparatus includes a contacting element configured to engage input media during a feed operation such that the contacting element may selectively adhere to unacceptable input media and move with such unacceptable input media during the feed operation. The apparatus also includes a sensor configured to identify displacement of the contacting element, such displacement being indicative of unacceptable input media.

DETAILED DESCRIPTION OF THE PREFERRED EMBODIMENT

Figure 1:
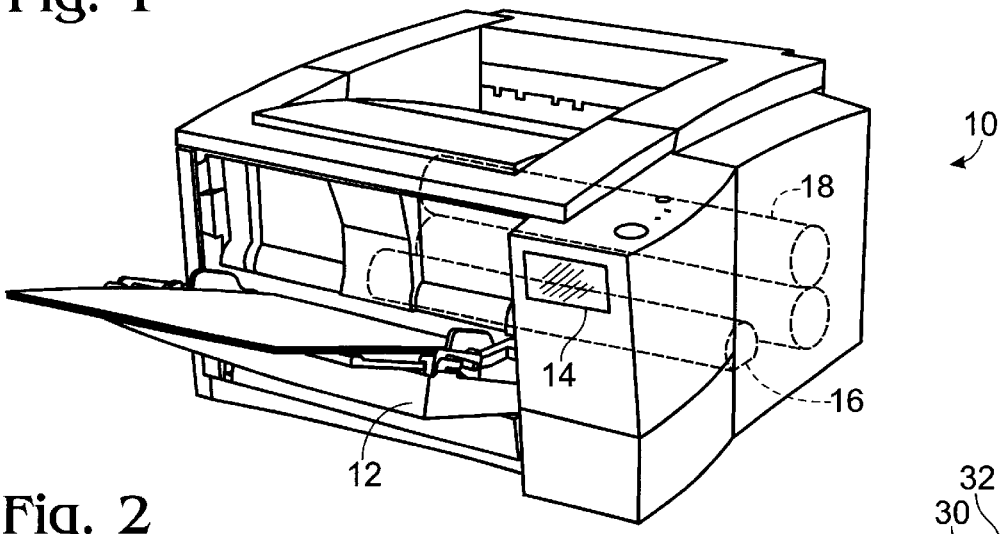
FIG. 1 is an isometric drawing of a printer employing an unacceptable media detection apparatus according to an embodiment of the invention.

Referring first to FIG. 1, a printer according to an embodiment of the present invention is indicated generally at 10. As shown in FIG. 1, printer 10 may take the form of a laser printer having a media storage tray 12 which carries input media, such as paper or transparent media. A printer message display 14 may be used to display information regarding printer status, such as messages regarding the presence of unacceptable input media in media storage tray 12.

In operation, input media may be fed from storage tray 12 using a media feed mechanism such as roller 16. In the case of the depicted laser printer, media from storage tray 12 is fed along a media feed path to a fuser 18. After the input media is fed from storage tray 12, but prior to the media reaching the fuser 18, toner is applied to the media forming an image. When the media passes through the fuser a combination of heat and pressure melts the toner, causing it to adhere to the media and making the image permanent.

As indicated above, certain types of media (such as inkjet transparent media) may have a melting point at or below the fusing temperature of fuser 18. Accordingly, if such media comes in contact with fuser 18, it may melt, wrapping around fuser 18 so as to render fuser 18 unusable, and printer 10 inoperative, until appropriate repairs are made. Input media having a melting point at or below the fusing temperature of a laser printer thus are designated unacceptable for use in such laser printer. Similarly, input media which is unable to withstand the printing temperature associated with a different printing operation may be deemed unacceptable for such printing operation.

Figure 2:
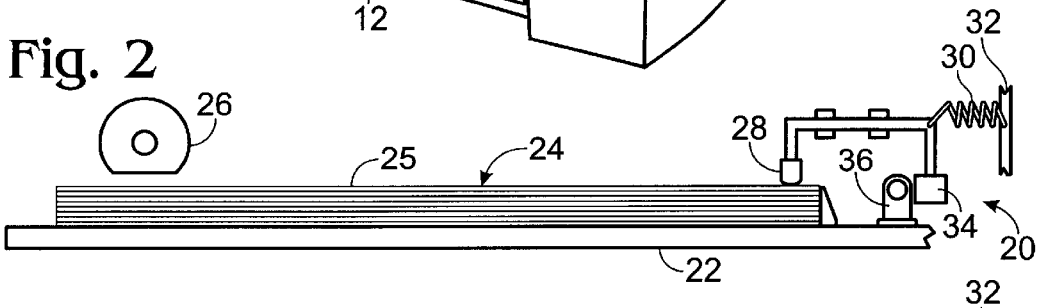
FIG. 2 is a side elevation view illustrating an unacceptable media detection apparatus in accordance with an embodiment of the invention, the apparatus being shown in a nominal state with a contacting element in a corresponding nominal position.

Referring now to FIG. 2, an unacceptable media detection apparatus according to an embodiment of the present invention is indicated generally at 20. Media detection apparatus 20 may be included in laser printer 10, though the invention is not limited in scope to use with any particular type of printing device. As may be seen in FIG. 2, media detection apparatus 20 may be employed in a printing device having an input media storage tray 22 which carries an input media stack 24. In the depicted embodiment, a next-to-be-fed media sheet 25 is typically on top of media stack 24 to accommodate contact by a media feed mechanism such as feed roller 26, which directs passage of media from the input media storage tray along a media feed path as described above. It will be appreciated that the media feed mechanism may be a tactile roller, as shown, or any other mechanism capable of feeding input media from an input media source.

As may be seen in FIG. 2, unacceptable media detection apparatus 20 includes a contacting element 28, which may be placed in contact with next-to-be-fed media sheet 25. Contacting element 28 may take the form of a heated element, which, in operation, may be maintained at a temperature approximately equivalent to the printing temperature (e.g., the fusing temperature of fuser 18). This arrangement may accommodate selective adherence of contacting element 28 to adhere to input media which has a melting point at or below the printing temperature. Upon movement of next-to-be-fed media sheet 25, contacting element 28 also may be movable, such movement of the contacting element being indicative of unacceptable input media.

Figure 3:
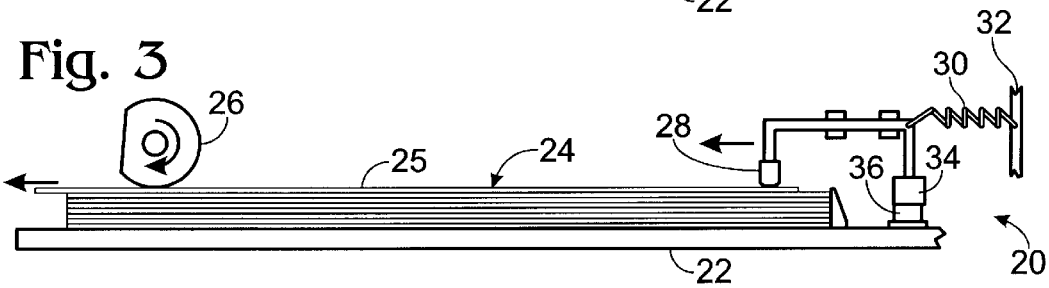
FIG. 3 is a side elevation view illustrating the unacceptable media detection apparatus of FIG. 2, but with the apparatus in an unacceptable-media-indicating state with the contacting element displaced from the nominal position to an unacceptable-media-indicating position.

Referring now to FIGS. 2 and 3, it will be noted that contacting element 28 may be coupled, via a spring 30, with a reference structure 32. Reference structure 32 typically is fixed within printer 10, possibly forming a part of the printer chassis or frame. It is to be understood that contacting element 30 28 may be biased toward a nominal position adjacent reference structure 32 by spring 30 (as shown in FIG. 2). Upon feeding of media sheet 25 (to which contacting element 28 is adhered), and corresponding movement of contacting element 28, spring 30 may be extended to an unacceptable-media indicating position (as shown in FIG. 3). When a sufficient return force is provided by spring 30 to overcome adherence between contacting element 28 and media sheet 25, the contacting element returns to its nominal position, engaging a new, next-to-be-fed media sheet.

In order to accommodate detection of unacceptable input media, apparatus 20 may further include a sensor configured to identify displacement of the contacting element, such displacement indicating that media sheet 25 is unacceptable. The sensor may take the form of a switch, optical or otherwise, which is configured to actuate upon predetermined displacement of the contacting element. In FIG. 2, the sensor takes the form of such an optical switch, the sensor including a flag 34 and an optical detector 36.

As indicated in FIGS. 2 and 3, flag 34 may be coupled with contacting element 28 such that it moves with the contacting element. Correspondingly, optical detector 36 may be held stationary relative to reference structure 32 such that movement of flag 34 may be reliably sensed by the optical detector. Of coarse, the flag may be held stationary, and the optical detector moved. Such relative movement of flag 34 and optical detector 36, it will be appreciated, is indicative of movement of contacting member 28.

Once flag 34 has been displaced a predetermined distance, flag 34 may interrupt an optical beam projected by optical detector 36. Optical detector 36 may thus be actuated, and the media feed mechanism signaled to discontinue input media feed. This may prevent media sheet 25 from contacting fuser 18 and, therefore, may prevent damage to fuser 18 in printer 10. A notification may be provided on printer message display 14, indicating that unacceptable input media is present in media storage tray 22.

Of course, It will be appreciated that the aforementioned optical sensor may involve a stationary flag, and selectively movable optical detector, and/or may involve a change between a nominal flag position interrupting an optical detector's optical beam and a unacceptable-media-indicating position not interrupting the optical detector's optical beam. Alternatively, the sensor may be a mechanical switch, a magnetic switch, or any other type of mechanism that may be used to indicate the position of contacting element 28.

Figure 4:
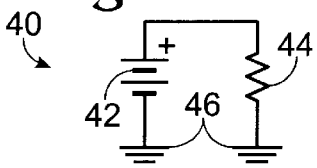
FIG. 4 is a schematic diagram illustrating a heating circuit that may be used to heat a contacting element in the unacceptable media detection apparatus shown in FIGS. 2 and 3.

Referring now to FIG. 4, a schematic diagram of a heating circuit 40 according to one embodiment of the present invention is depicted. Heating circuit 40 will be seen to include a power supply 42 and a positive-temperature-coefficient thermistor (thermal-resistor) 44. Heating circuit 40 is thus designated a thermistor circuit. As may be seen in FIG. 4, the negative terminal of power supply 42 and one terminal of thermistor 44 are electrically coupled with a common ground 46. Also, the positive terminal of power supply 42 is electrically coupled with a second terminal of thermistor 44. The thermistor functions to heat the contacting element to a media-selecting temperature approximately equivalent to the printing temperature (the fusing temperature in the printer of FIG. 1). The contacting element is typically be made of metal. The thermistor thus may be attached to the contacting element by a means that has a low thermal resistance so that the temperature of the contacting element is substantially equal to the thermistor temperature. The surface of the contacting element that touches the media typically is smooth so that there is normally little friction between the contacting element and the media. However, if the media begins to melt, there is significant friction between the contacting element and the media to pull the contacting element with the media as the media advances.

Figure 5:
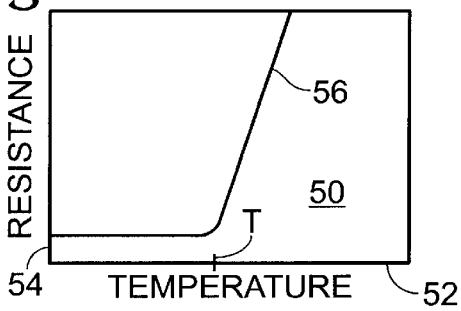
FIG. 5 is a is a graph illustrating the relationship of resistance to temperature for the heating circuit shown in FIG. 4.

FIG. 5 is a graph 50 showing temperature versus resistance characteristics for thermistor 44. The x-axis 52 represents the temperature of thermistor 44, while the y-axis 54 represents the resistance of thermistor 44. As may be seen from curve 56 in FIG. 5, once thermistor 44 reaches a temperature T, resistance of thermistor 44 may increase rapidly. This increase in resistance will result in thermistor 44 maintaining a substantially constant temperature when included in the heating circuit shown in FIG. 4. As was previously indicated, temperature T may correspond to the printing temperature (e.g., the temperature of fuser 18 in printer 10).

Figure 6:
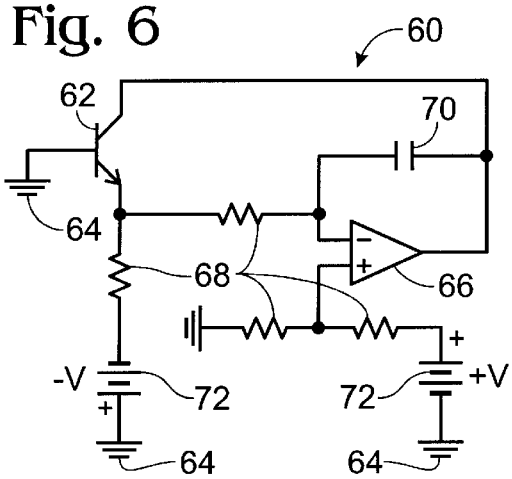
FIG. 6 is a schematic diagram illustrating an alternative heating circuit for use with the media detection apparatus shown in FIGS. 2 and 3.

Referring now to FIG. 6, a schematic diagram of an alternative heating circuit is provided, and is indicated generally at 60. Heating circuit 60 includes a bipolar transistor 62 which serves to heat the contacting element. As may be seen in FIG. 6, the base of transistor 62 is electrically coupled with common ground 64, while the collector and emitter of transistor 62 are electrically coupled with a feedback circuit that includes comparator 66, resistors 68, capacitor 70 and power supplies 72. It will be appreciated that such a circuit may sense an emitter voltage of transistor 62 and compare that voltage with a reference voltage. Based on this comparison, current flow to the collector of transistor 62 may be controlled and the temperature of transistor 62 may, as a result, be maintained at a media-selecting temperature substantially equivalent to the printing temperature (e.g. the fusing temperature of fuser 18 in printer 10).

A Method of detecting presence of unacceptable print media in a printer thus is provided wherein the method includes providing a heated element in contact with to-be-fed input media, heating the heated element to a media-selecting temperature approximately equivalent to a melting temperature of unacceptable input media so as to selectively adhere the heated element to unacceptable input media, feeding the input media into the printer, the heated element being moved with media to which the heated element is adhered, and sensing displacement of the heated element to detect adherence of the heated element to input media, and thus to detect presence of unacceptable input media. Upon detecting the presence of unacceptable input media, feed of input media may be discontinued and detection of such unacceptable input media may be indicated to the user.

While the present invention has been particularly shown and described with reference to the foregoing depicted embodiments, those skilled in the art will understand that many variations may be made therein without departing from the spirit and scope of the invention as defined in the following claims. The description of the invention should be understood to include all novel and non-obvious combinations of elements described herein, and claims may be presented in this or a later application to any novel and non-obvious combination of these elements. The foregoing embodiments are illustrative, and no single feature or element is essential to all possible combinations that may be claimed in this or a later application. Where the claims recite "a" or "a first" element or the equivalent thereof, such claims should be understood to include incorporation of one or more such elements, neither requiring nor excluding two or more such elements.

What is claimed is:

1. An apparatus for use in detecting unacceptable input media, the apparatus comprising:

a contacting element configured to engage input media during a feed operation, the contacting element being configured to selectively adhere to unacceptable input media and move with such unacceptable input media during the feed operation; and a sensor configured to identify displacement of the contacting element, such displacement being indicative of unacceptable input media.

2. The apparatus of claim 1, wherein acceptability of input media is related to melting temperature of the input media, and wherein the contacting element includes a heating element heated to a media-selecting temperature at or above a melting temperature of unacceptable media.

3. The apparatus of claim 1, wherein the sensor includes a switch configured to actuate upon predetermined displacement of the contacting element, thereby indicating presence of unacceptable input media.

4. The printing device of claim 1, wherein the sensor is an optical sensor having an optical detector and a flag, one of the optical detector and the flag being operatively coupled with the contacting element for movement relative the other of the optical detector and flag such that the optical sensor is actuated upon predetermined displacement of the contacting element, thereby indicating presence of unacceptable input media.

5. The apparatus of claim 1, which further comprises a display configured to indicate detection of unacceptable input media.

6. The apparatus of claim 1, wherein the contacting element is biased toward a nominal position so as to nominally indicate presence of acceptable input media.

7. In a printing device having a printing temperature, a media detection apparatus comprising:

a heated element configured to engage input media during a feed operation, the heated element being heated to a temperature approximately equivalent to the printing temperature so as to selectively adhere to input media with a melting point at or below the printing temperature, and to move from a nominal position with such input media during the feed operation; and a sensor configured to identify selected displacement of the heated element from the nominal position, such displacement being indicative of adherence of the heated element to the input media, and thus being indicative of input media with a melting point at or below the printing temperature.

8. The apparatus of claim 7, wherein the heated element is biased toward the nominal position so as to nominally indicate input media with a melting point above the printing temperature.

9. The apparatus of claim 7, wherein the sensor includes a switch configured to actuate upon selected displacement of the heated element from the nominal position, thereby indicating presence of input media with a melting point at or below the printing temperature.

10. The printing device of claim 7, wherein the sensor is an optical sensor having an optical detector and a flag, one of the optical detector and the flag being operatively coupled with the heated element for movement relative the other of the optical detector and flag such that the optical sensor is actuated upon selected displacement of the heated element from the nominal position, thereby indicating presence of input media with a melting point at or below the printing temperature.

11. The apparatus of claim 7, which further comprises a display configured to indicate presence of input media with a melting point at or below the printing temperature upon identification of selected displacement of the heated element from the nominal position by the sensor.

12. The apparatus of claim 7, wherein the heated element is heated via a thermistor circuit.

13. The apparatus of claim 12, wherein the thermistor circuit includes a power supply with a first terminal of the power supply electrically coupled with a common ground and a second terminal of the power supply electrically coupled with a first terminal of a positive-temperature-coefficient thermistor, and with a second terminal of the thermistor electrically coupled with the common ground.

14. The apparatus of claim 7, wherein the heated element is heated via a bipolar transistor feedback circuit.

15. A printing device comprising:

a toner fuser having a fusing temperature;

a feed mechanism; and a media detector configured to detect presence of input media with a melting point below the fusing temperature, and to disable the feed mechanism upon detecting presence input media with a melting point at or below the fusing temperature.

16. The printing device of claim 15, wherein the media detector includes a heated element in contact with input media and heated to a temperature approximately equivalent to the fusing temperature of the toner fuser, the heated element thus being configured to melt input media with a melting point at or below the fusing temperature, and to adhere to such input media, thereby signifying presence of input media with a melting point at or below the fusing temperature.

17. The printing device of claim 16, wherein the heated element is configured to move with the input media upon adhering to such input media.

18. The printer of claim 17, wherein the media detector further includes a switch configured to actuate upon predetermined displacement of the heated element.

19. The printing device of claim 17, wherein the media detector further includes a sensor configured to sense movement of the heated element, such movement being indicative of adherence of the heated element to the input media.

20. The apparatus of claim 17, wherein the heated element is biased toward the nominal position so as to nominally indicate input media with a melting point above the fusing temperature.

21. The printing device of claim 17, wherein the media detector further includes an optical detector and a flag, one of the optical detector and the flag being operatively coupled with the heated element such that the optical detector is actuated upon the heated element being displaced a predetermined distance.

22. The printer of claim 16, wherein the heated element is heated via a thermistor circuit.

23. The apparatus of claim 16, wherein the heated element is heated via a bipolar transistor feedback circuit.

24. The printer of claim 15, further comprising a display configured to indicate detection of input media with a melting point at or below the fusing temperature.

25. An apparatus for use in detecting unacceptable input media, the apparatus comprising:

a contacting means configured to engage input media during a feed operation, the contacting means being biased toward a nominal position, but configured to selectively adhere to unacceptable input media and move with such unacceptable input media during the feed operation; and a sensor means configured to identify displacement of the contacting element, such displacement being indicative of unacceptable input media.

26. The apparatus of claim 25, which further comprises a display means configured to indicate detection of unacceptable input media to a user.

27. The apparatus of claim 25, wherein acceptability of input media is related to melting temperature of the input media, and wherein the contacting means includes a heated element heated to a media-selecting temperature at or above a melting temperature of unacceptable media.

28. The apparatus of claim 25, wherein the sensor means includes a switch configured to actuate upon predetermined displacement of the contacting means, thereby sensing presence of unacceptable input media.

29. A Method of detecting presence of unacceptable print media in a printing device, the method comprising: providing a heated element in contact with to-be-fed input media;

heating the heated element to a media-selecting temperature approximately equivalent to a melting temperature of unacceptable input media so as to selectively adhere the heated element to unacceptable input media;

feeding the input media into the printing device, the heated element being moved with media to which the heated element is adhered; and sensing displacement of the heated element to detect adherence of the heated element to input media, and thus to detect presence of unacceptable input media.

30. The method of claim 29, which further comprises, upon detecting presence of unacceptable input media, discontinuing feed of input media.

31. The method of claim 29, which further comprises biasing the heated element toward the nominal position so as to nominally indicate presence of acceptable input media.

32. The method of claim 29, which further comprises, upon detecting presence of unacceptable input media, indicating detection of such unacceptable input media to a user.

* * * * *